US005894117A

United States Patent [19]

Kamishima

[11] Patent Number: 5,894,117

[45] Date of Patent: Apr. 13, 1999

[54] KEYBOARD SWITCH FOR NOTEBOOK TYPE COMPUTER OR THE LIKE

[75] Inventor: Osamu Kamishima, Toyamama-ken, Japan

[73] Assignee: SMK Co., LTD., Tokyo, Japan

[21] Appl. No.: 08/893,999

[22] Filed: Jul. 17, 1997

[30] Foreign Application Priority Data

Dec. 26, 1996 [JP] Japan ..... 8-356829

[51] Int. Cl.[6] ..... H01H 3/12

[52] U.S. Cl. ..... 200/344

[58] Field of Search ..... 200/344

[56] References Cited

U.S. PATENT DOCUMENTS 5,519,569 5/1996 Sellers ..... 200/344 X 5,555,971 9/1996 Takada ..... 200/344 X

*Primary Examiner*—Renee S. Luebke

*Attorney, Agent, or Firm*—McDermott, Will & Emery

[57] ABSTRACT

A keyboard switch having a keytop which is displaced vertically by a cross link that comprises a first link member and a second link. A front edge side of the keytop comes slightly lower than its rear edge side and the cross link is configured so that the pushdown stroke is greater on the rear edge side than on the front edge side and that the top face of the keytop. When the keytop is pushed down completely, it comes almost parallel to a frame of the keyboard switch. This configuration, when adopted, for example, to a notebook type personal computer with a lid, results in sliding an elastic portion which holds up the keytop in interlock with the lid closing, thus the keytop, as a whole horizontal. This configuration wherefore allows achieving otherwise contradictory effects of a great stroke when the lid is opened and a thinner notebook when the lid is closed. Further, the top surface of the keytop when it becomes nearly parallel, facilitates character printing improving the printing yield.

8 Claims, 6 Drawing Sheets

Fig. 7
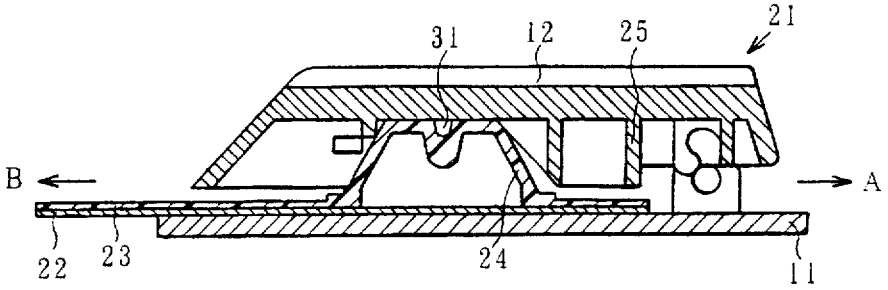
Fig. 8A
PRIOR ART
Fig. 8C
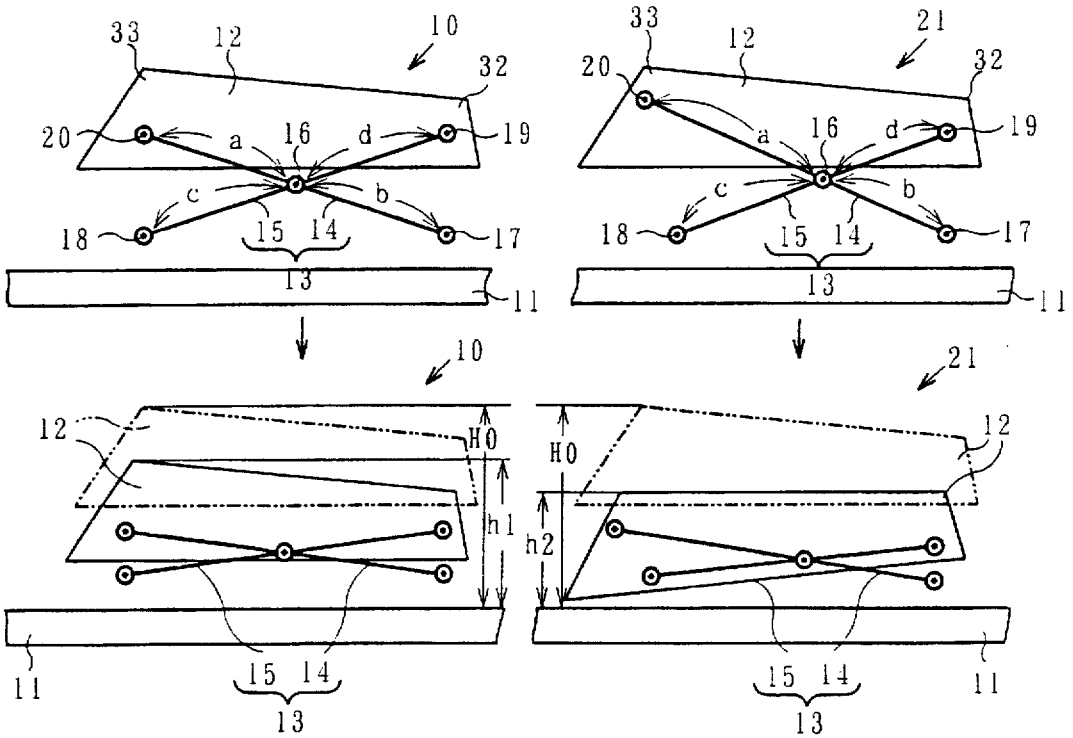
Fig. 8B
PRIOR ART
Fig. 8D

KEYBOARD SWITCH FOR NOTEBOOK TYPE COMPUTER OR THE LIKE

BACKGROUND OF THE INVENTION (1) Field of the Invention

This invention relates generally to a keyboard switch and more particularly to an improved thin type keyboard switch suited for use with notebook type personal computers.

(2) Description of the Prior Art

In a thin type keyboard switch, in order to improve operability, the keytop is usually slanted with the front edge side, which is nearer to an operator, slightly lower than the rear edge side.

A variety of mechanisms which enable smooth vertical displacement of these keytops have been proposed. One of these mechanisms utilizes a crosslink.

As shown in FIG. 9, this crosslink 13 arrangement includes central fulcrums 16, a first link arrangement 14 composed of two parallel links connected to a transverse member, and a second link arrangement 15 composed similarly of two parallel links connected with another transverse member. Right and left fixed fulcrums 17 and 17, are located at one end of each of the links of the first link arrangement 14, while traveling or moving fulcrums 18 and 18, are located at the other end of the links of the second link arrangement 15. These moving fulcrums 18, 18 engage the frame 11 in such a fashion that they can be displaced horizontally with respect thereto. In addition, right and left fulcrums 20 and 20 on the other ends of the links of the first link arrangement 14, are supported on the lower face of the keytop 12 so that they may be displaced horizontally, while right and left fulcrums 19 and 19 on the other end of the links of the second link arrangement 15, are pivotably supported on the lower face of the keytop 12.

In the crosslink 13 of the conventional keyboard switch 10, the ratio of the left to right length (a:b) of the first link arrangement 14 as divided by the rotatable fulcrum 16, is almost 1:1 as shown in FIGS. 8A and 8B. Similarly, the ratio of left to right length (c:d) of the second link arrangement 15 as divided by the rotatable fulcrum 16, is almost 1:1 also as shown in FIGS. 8A and 8B. Thus, the fulcrums 17, 18, 20, and 19 are located in a manner which outlines a parallelogram.

In such a crosslink 13, which outlines the parallelogram, the fulcrums 18 and 20 displace horizontally while approaching one another as the keytop is pushed down, which the keytop 12 remains slanted as it descends. At that time, the front edge side 32 of the keytop 12 reduces to a height of h2, while the rear edge side 33, whose original height was H0, only lowers to a height of h1.

Thus, the top face of the keytop 12, which is slanted with the lower front edge side 32 and higher rear edge side 33, facilitates visual recognition of the characters on the respective keys of a keyboard and improves the operablilty of the same.

In the foregoing conventional keyboard switch 10, however, the keytop 12 is pushed down while still slanted. The height of the keytop 12 may therefore be decreased only to h1. The thickness of the notebook type personal computer which utilizes this type of keyboard switch is thus limited. Therefore, particularly in a conventional notebook type personal computer with a display mounted in its lid, the thinness of the notebook with all the keytops 12 pushed down, has been limited when the lid is closed.

The character printing which is carried out using a silk screen technique, for instance, is provided on each keytop 12 only after all the keytops 12 are mounted on the frame 11. Thus, in conventional notebook type personal computers, the top faces of the plural keytops 12 become slanted and are arranged in corrugated multiple stages, which cause the problem that the character printing is troublesome and exhibits a poor yield.

BRIEF SUMMARY OF THE INVENTION

The primary object of this invention is to render the keyboard switch as a whole, thinner. The second objective is to improve the yield of the character printing on the keytop.

To achieve these goals, the keytop 12 is arranged to be initially slanted with its front edge side 32 slightly lower than its rear edge side 33. This keytop 12 is arranged so that as it is displaced vertically downward on a crosslink 13, composed of the first link arrangement 14 and the second link arrangement 15, the crosslink 13 undergoes a larger pushdown stroke at the rear edge side 33 than at the front edge side 32, and the top face of the keytop 12, when it is fully depressed, is almost parallel to a frame 11.

This configuration allows a pushdown or depression stroke at the rear edge side 33 which is larger than that on the front edge side 32. Accordingly, when the keytop 12 is pushed down to its deepest position, the front edge side 32 on the top face of the keytop 12 assumes the same height h2 as that of the rear edge side 33 (viz., becomes essentially parallel to the frame 11).

This structure therefore permits apparently contradictory effects to take place at the same time. That is to say, it enables a greater stroke when the lid is opened, on the one hand, and the thinner notebook when the lid is closed, on the other. Further, since the top face of the keytop 12 can induced to become nearly parallel to the frame, the character printing is rendered easier, and the printing yield is enhanced.

These objects together with others not specifically mentioned here will become clearer to those skilled in the art from the following description.

BRIEF DESCRIPTION OF THE DRAWINGS

FIG. 6A is a plan view of the crosslink 13 before the keytop 12 is pushed down, and FIG. 6B is a plan view of the same crosslink 13, after the keytop 12 is pushed down.

FIG. 7 is a longitudinal sectional view of the keyboard switch wherein the frame 11 and the keytop 12 displace together in synchronism with the lid closing action or a membrane switch sheet 22 and a rubber sheet 23 displace together, and wherein the elastic portion 24 is fitted into the elastic portion housing concave portion 31.

FIGS. 8A to 8D are explanatory drawings illustrating the function of the keyboard switch, wherein FIGS. 8A and 8B diagrammatically depict the action of the conventional keyboard switch 10, and wherein FIGS. 8C and 8D depict, also diagrammatically, the action of the keyboard switch according to this invention.

DETAILED DESCRIPTION

Figure 1:
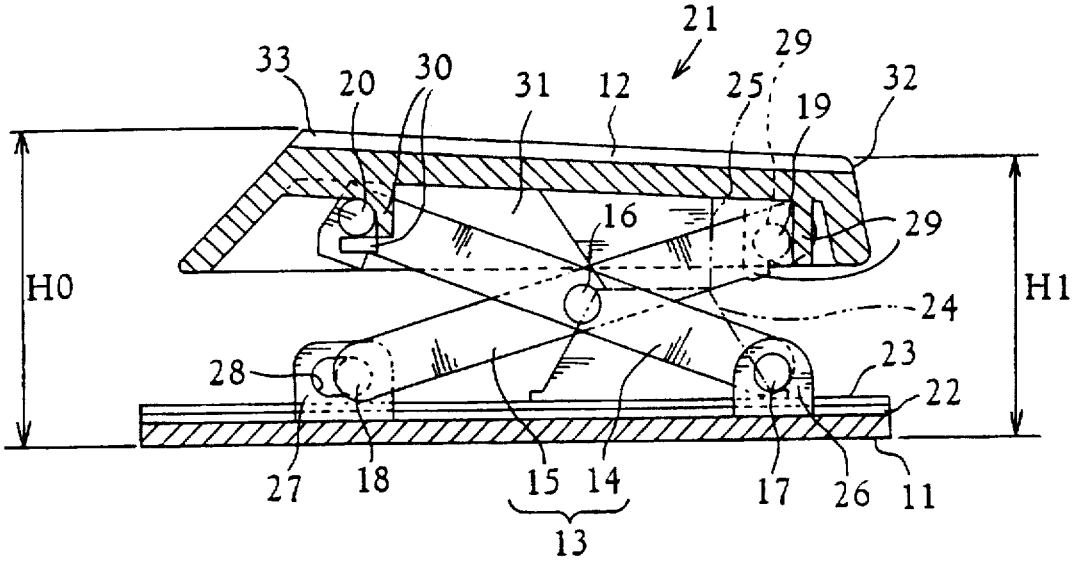
FIG. 1 is a longitudinal sectional view of a keyboard switch 21 embodying the invention.

Referring now to the drawings, we will describe an embodiment of this invention.

FIGS. 8C and 8D depict the principle of operation of the keyboard switch 21 according to the invention wherein the crosslink 13 is used.

Figure 9:
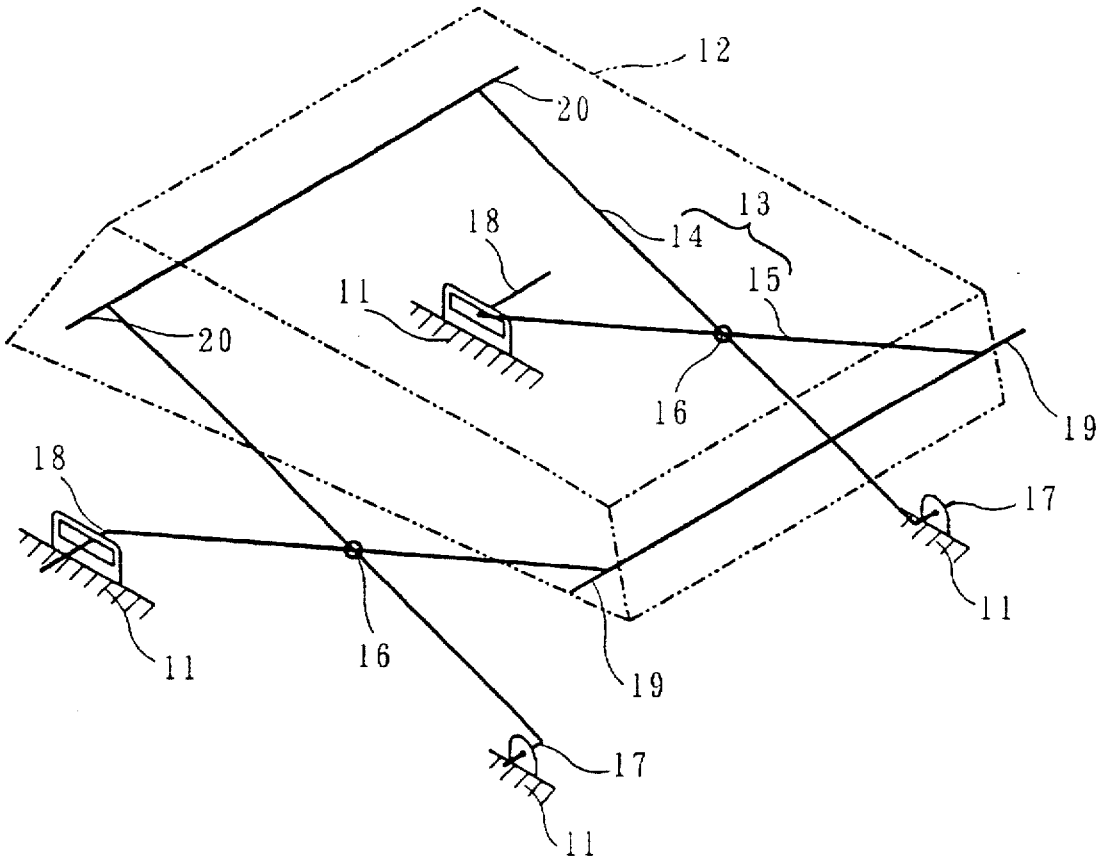
Fig. 9 PRIOR ART
FIG. 9 is a perspective view that outlines the conventional crosslink 13 discussed in the opening paragraphs of this disclosure.

The crosslink 13 in FIGS. 8C and 8D is arranged so that the central rotating fulcrums 16 interconnect the two parallel links of the first link arrangement 14 which are each integratedly connected with a transverse member, with the two parallel links of the second link arrangement 15 which are similarly integratedly connected with a transverse member. The right and left fixed fulcrums 17 and 17 at the one end of the first link arrangement 14 pivotably span the frame 11, while the travelling fulcrums 18 and 18 on the right and left sides of an end of the second link arrangement 15 are journaled to the frame 11 in such a fashion that they can be displaced horizontally with respect to the frame. The right and left fulcrums 20 and 20 at the other end of the first link arrangement 14, are supported on the bottom face of the keytop 12 so that they may be displaced horizontally, while the right and left fulcrums 19 and 19 on the other end of the second link arrangement 15, pivotably span the bottom face of the keytop 12 and are pivotally connected to this surface. This basic configuration is the same as the conventional one shown in FIG. 9 and FIGS. 8A and 8B.

The construction according to this invention is characterized in that when the keytop 12, which is slantedly disposed with its front edge side 32 lower than its rear edge side 33, is pushed down, the front edge side 32 lowers to the same height h2 as that of the rear edge side 33 (viz., the keytop becomes almost parallel to the frame 11).

More particularly, with the crosslink 13 that connects the first link arrangement 14 and the second link arrangement 15, each rotatable fulcrum 16 is, as shown in FIGS. 8C and 8D, arranged nearer to the front edge side 32 so as to be forward of the intermediate positions of these link arrangements 14 and 15, and such that the pushdown stroke becomes greater at the rear edge side 33 than at the front edge side 32, when the keytop 12 is pressed down.

More specifically, the left length to right length ratio, a:b, of the first link member 14 as divided by the rotatable fulcrum 16 in the keyboard switch, and the same ratio, c:d, of the second link member 15 as divided by the rotatable fulcrum 16 are related such that a>b and a>d or c>d and c>b.

If the keytop 12 in such a mechanism is pushed down from its top side, both the moving fulcrums 18 and 18 on the retainer plate side and the moving fulcrums 20 and 20 on the keytop side, displace slightly forward in the horizontal direction thereby collapsing the parallelogram outlined by the fulcrums 17, 18, 20 and 19. Because the longer portion of the divided link member has a greater pushdown stroke than the shorter one, this stroke becomes greater at the rear edge side 32 than at the front edge side 31. When the keytop 12 is depressed to the deepest position, the front edge side 32 on the top face of the keytop 12 assumes the same height h2 as the rear edge side so that the top face becomes almost parallel to the frame 11 which retains the switch.

Referring now to FIGS. 1 to 4, the configuration will be described more concretely.

The keyboard switch 21 by the present invention mainly consists of a frame 11 to hold the switch, a membrane switch sheet 22, an elastic portion 24, a keytop 12, a crosslink 13, and a push pressure projection 25.

Figure 3:
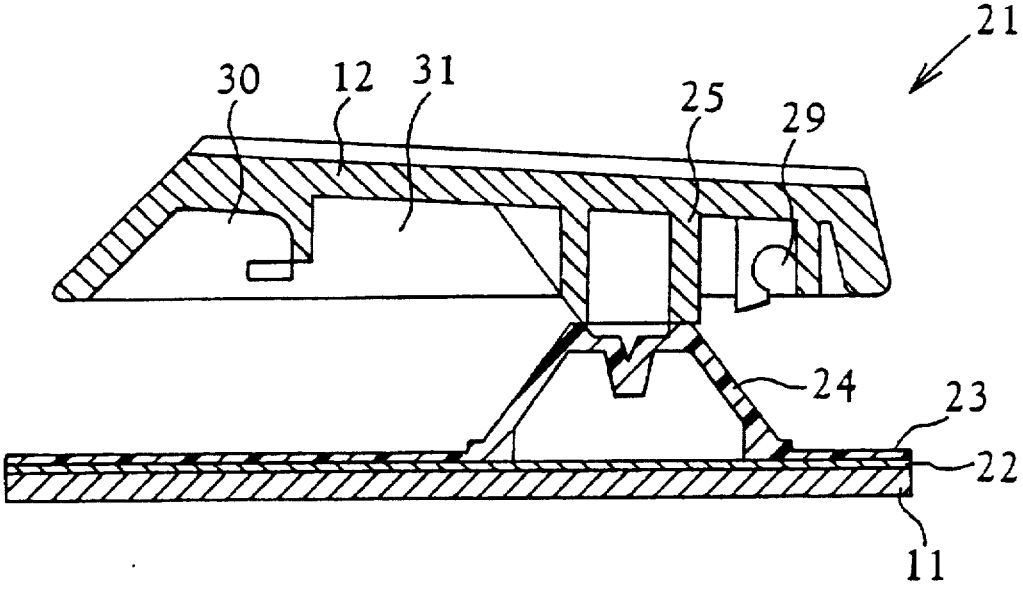
FIG. 3 is yet another longitudinal sectional view of the keyboard switch 21, which omits the crosslink 13, and which shows the keytop 12 raised by elastic portion 24.

The keytop 12 is a molding of synthetic resin such as ABC resin. As shown in FIGS. 1 and 3, a fixed fulcrum holding portion 29 is formed on the front edge side 32 on the bottom face of the keytop 12, while a displacing fulcrum holding portion 30 is formed on the rear edge side 33. The push-pressure projection 25 is formed at a position which is nearer to the front edge side 32 than the center, with an elastic portion housing concave portion 31 coming between this push-pressure projection 25 and the displacing fulcrum holding portion 30.

Figure 5A:
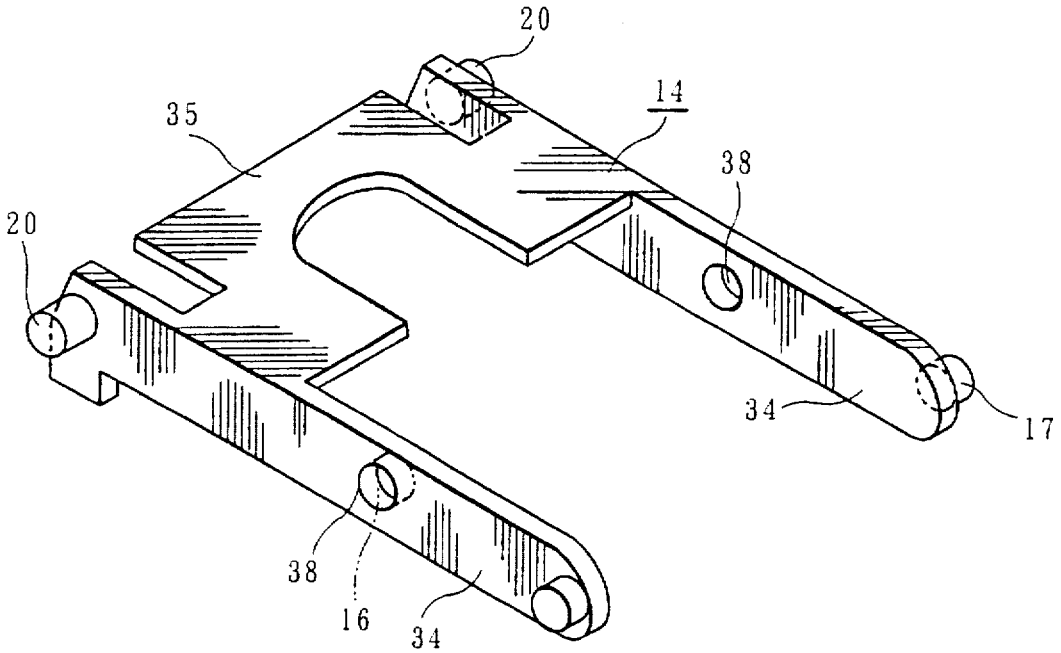
FIGS. 5A and 5B are exploded perspective views illustrating the crosslink 13.
Figure 5B:
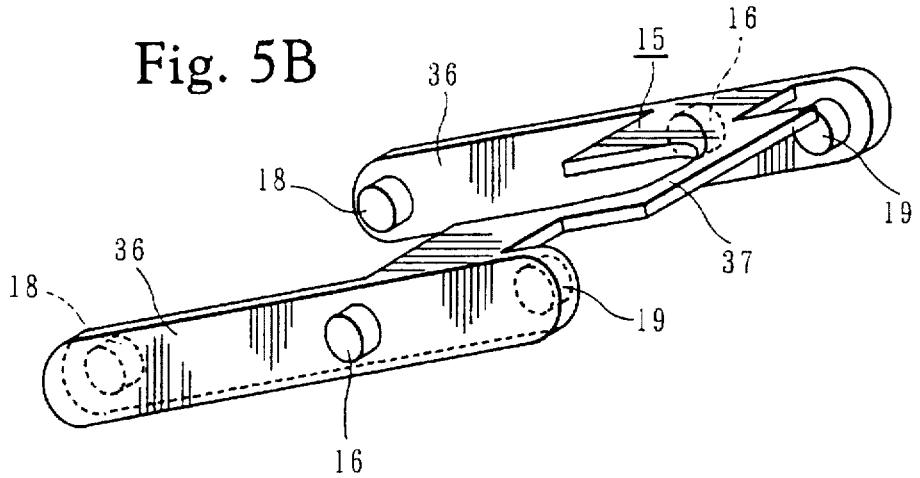

The crosslink 13 shown in FIG. 5, includes the shaft hole 38 of the first link member 14, composed of the two parallel links 34 integratedly connected to a transverse link member 35, and the rotatable fulcrum 16 of the second link member 15 composed similarly of the two parallel links integratedly connected with the transverse link member 37.

The right and left fixed fulcrums 17 and 17, on the one end of the first link member 14 pivotably spanned on the fixed fulcrum receiving portion 26 of the frame 11, while the traveling fulcrums 18 and 18, on the right and left sides of an end of the second link member 15, are received in oval aperture 28 of the displacing fulcrum receiving portion 27 in such a fashion that they can be displaced horizontally with respect to the frame. The right and left fulcrums 20 and 20, on the other end of the first link member 14, are supported on the displacing fulcrums holding portion 30 on the bottom face of the keytop 12 so that they may be displaced horizontally, while the right and left fulcrums 19 and 19 on the other end of the second link member 15 pivotably span the fixed fulcrum holding portion 29 on the bottom face of the keytop 12 so that they may pivot on this surface.

Similarly, as shown in FIGS. 8C and 8D, the positions of the rotatable fulcrums 16 of the crosslink 13, are set nearer to the front edge side 32 than the intermediate positions of the first and second link members. More specifically, the ratio of the left to right length (a:b) of the first link member 14 as divided by the rotating fulcrum 16, and the ratio of the left to right length (c:d) of the second link member 15 as divided by the rotating fulcrum 16 (c:d) establish a relationship of a>b and a>d or c>d and c>b.

Figure 2:
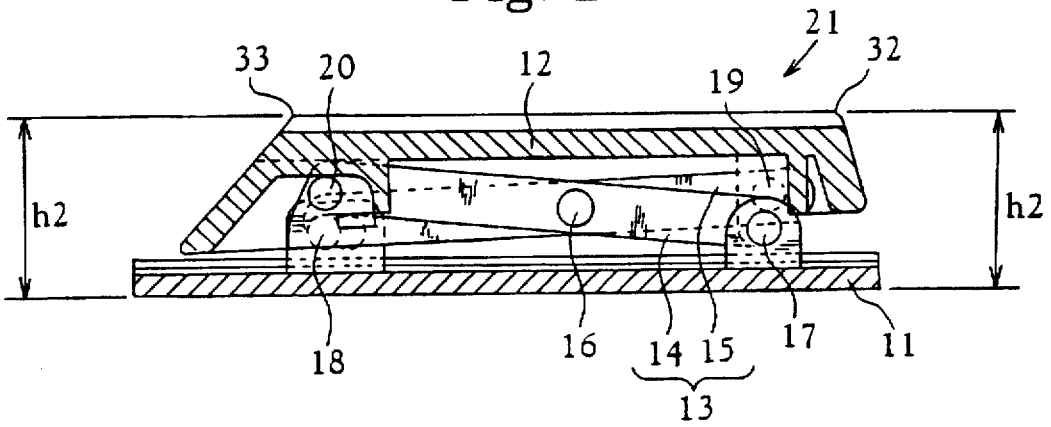
FIG. 2 is another longitudinal sectional view of the same embodiment as in FIG. 1 but showing the keytop 12 pushed down.

The keyboard 12, when it is raised, has a slanted surface with the height H0 of its rear edge side 33 greater than that (H1) of the front edge side 32. In this state, the pushdown stroke of the keytop 12 is higher on the rear edge side 33 than on the front edge side 22. When the keytop 12 is depressed to the deepest position, the height of the rear edge side 33 becomes the same as that (h2) of the front edge side 32, as shown in FIG. 2.

The above mentioned elastic portion 24 is made of an elastic polymers as silicon rubber, and is molded so that it protrudes in a truncated conical form from the rubber sheet 23 laminated on the membrane switch sheet, in the manner shown in FIG. 3.

When the keytop 12 is not pushed down, the top face of said elastic portion 24 comes into contact with the bottom face of said push-pressure projection 25 of the keytop 12, raising the keytop 12 under the elastic force of the elastic portion 24.

Figures 6A, 6B:
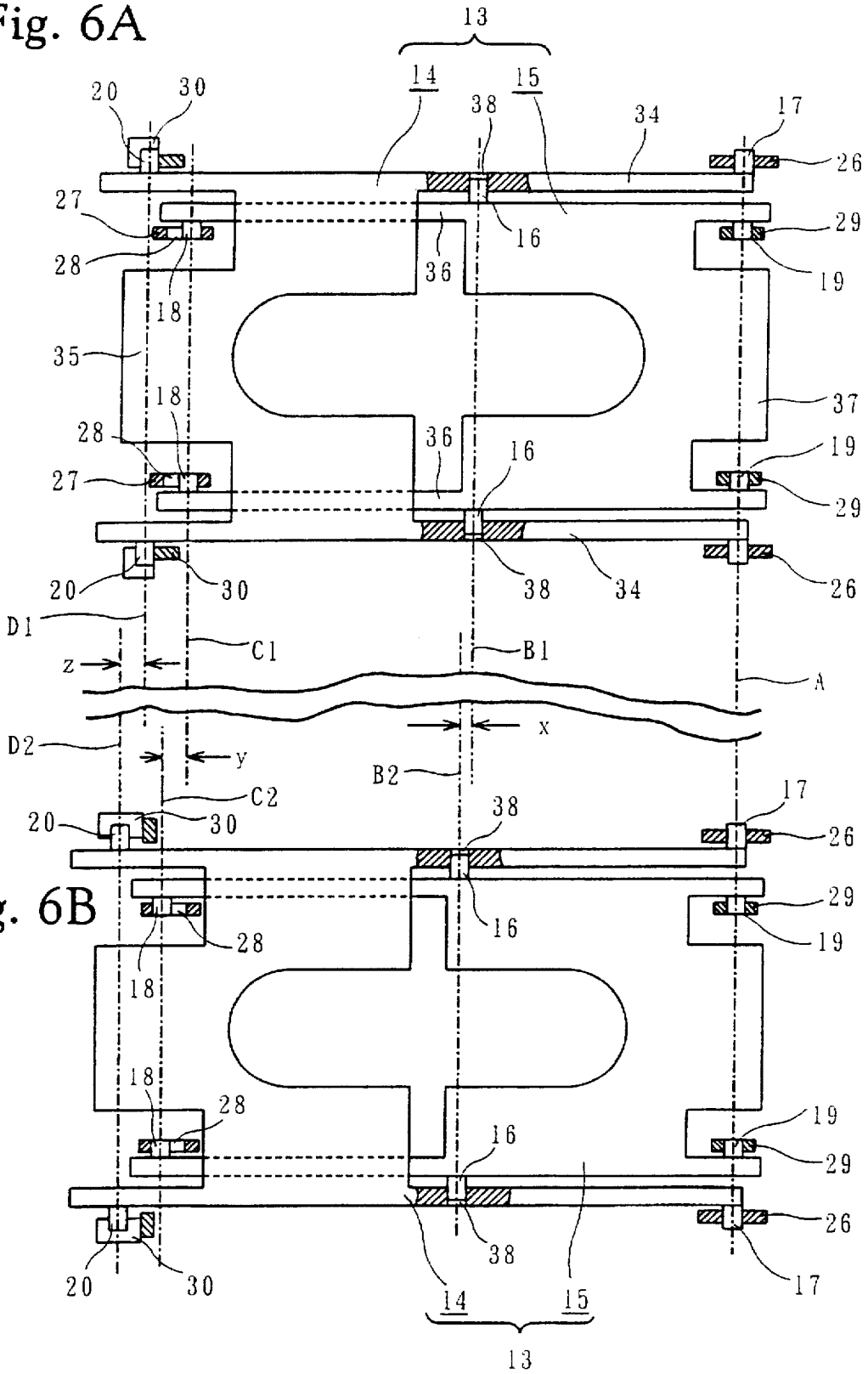
FIGS. 6A and 6B are plan views that depict the function of the crosslink 13, where

Assuming that the respective positions of the fulcrums 17, 16, 18 and 20 are A, B1, C1, and D1 when the keytop 12 is not pressed down as shown in FIG. 6A, if the keytop 12 is pushed down from this state, the fulcrums 17 remain fixed as shown in FIG. 6B, while the rotatable fulcrums 16 are displaced horizontally by distance x from point B1 to B2. At the same time, the moving fulcrums on the retainer plate side are slightly displaced horizontally by distance y from the point C1 to C2 and the moving fulcrums 20 and 20 on the keytop side, are slightly displaced in the horizontal direction by distance z from the point D1 to D2. These displacements cause the collapse the parallelogram outlined by the fulcrums 17, 18, 20 and 19.

Since the pushdown stroke is greater side 32, the top side 33 than on the front edge side 32, the top face of the keytop 12 assumes the same height h2 (almost parallel to the switch holding frame 11) on the front edge side 32 and rear edge side 33 if the keytop 12 is pushed down to its deepest position as shown in FIG. 2.

Figure 4:
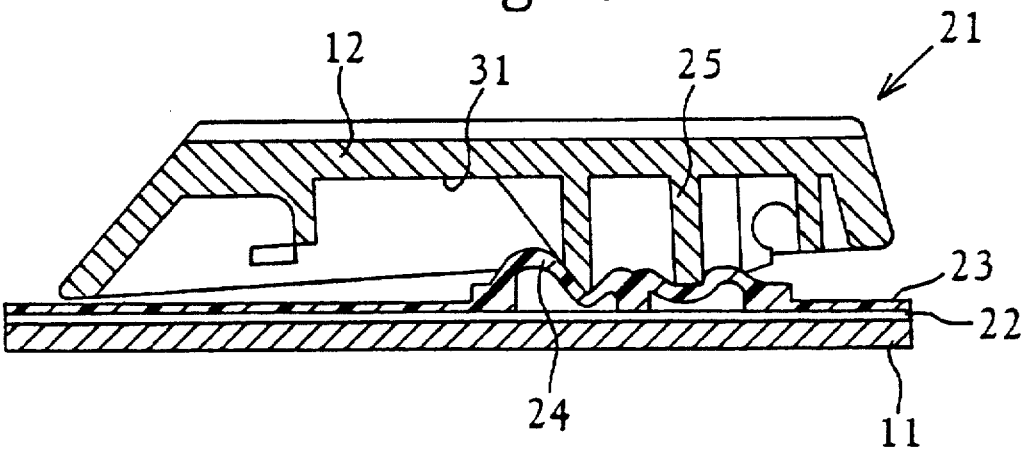
FIG. 4 is a longitudinal sectional view of a keyboard switch 21 wherein the elastic portion 24 is compressed and the keyboard switch 21 is pressed down from the position shown in FIG. 3.

When the keytop is pushed down to its lowermost position, the elastic portion 24 is crushed and collapsed by the push-pressure projection 25 on the bottom face of the keytop as shown in FIG. 4, and the bottom face of the elastic portion short-circuiting the electrode on the membrane switch sheet 22 to turn on the key switch and form a circuit.

If the push-down force of the keytop 12 is released, the keytop 12 is raised by the elastic force of the elastic portion 24 through the intermediary of the push-pressure projection 25 to turn off the key switch. Since the crosslink 13 rises up and the rising stroke is greater on the rear edge side 33 than on the front edge side 32 due to the length ratio of the first link member 14 to the second link member 15 as divided by the rotating fulcrums 16, the keytop 12 regains its slanted orientation.

It will now be described how the keyboard switch 21 by this invention is applied to the notebook personal computer with its display inside the lid.

When the operation of the notebook personal computer is completed and the lid is closed, the elastic portion 24, in synchronism with the closing action, displaces the membrane switch sheet 22 and rubber sheet 23 in the direction B in FIG. 7, by the distance just under the elastic portion housing concave portion 31 or else displaces the frame 11 and the keytop 12 in the direction A in the same figure.

As a result, the elastic portion 24 of the membrane switch sheet 22, and the push-pressure projection 25 of the keytop 12, do not come in contact with each other, the elastic portion 24 becomes fitted into the elastic portion housing concave portion 31, and the front edge portion 32 and rear edge portion 33 of the keytop 12 come to the same height h2 (parallel to the frame 11) thereby enabling the notebook personal computer to be thinner.

If the lid is opened again to use the computer, either the frame 11, or the membrane switch sheet 22, move in the opposite direction to the foregoing, and the elastic portion 24 and the push-pressure projection 25 slide on their respective slanted surfaces with the top face of the elastic portion contacting the bottom face of the push-pressure projection 25.

In the foregoing embodiment, the left length to right length ratio, a:b, of the first link member 14, as divided by the rotatable fulcrum 16, and the same ratio c:d of the second link member 15, as divided by the rotatable fulcrum 16, estabish respective relationship of a>b and a>d or c>d and c>b.

It is, however, to be understood that the form of this invention herein shown and described is to be taken only as a preferred example and that various changes may be made without departing from the spirit of the invention.

In short, it suffices if the pushdown stroke when the keytop is pressed down is greater on the rear edge side 33 than on the front edge side 32 and of that the height of the front edge side 32 becomes the same (h2, almost parallel to the frame) as that of the rear edge side 33 when the slanted keytop 12 is pushed down to its deepest position.

While the elastic portion 24 in the foregoing embodiment has been disclosed with reference to elastic polymers such as silicon rubber, the scope of the invention should not be limited thereto. A coil spring formed into truncated cone or folded plate spring can alternatively be used.

What is claimed is:

1. A keyboard switch comprising:

a switch holding frame;

a keytop having a top face, a front edge side and a rear edge side, said keytop being positioned at an uppermost position when the keyboard switch is not activated and at a lowermost position when the keytop is pressed vertically down for activation of the keyboard switch, said front edge side of the keytop being positioned lower than the rear edge side when the keytop is in the uppermost position, forming a slant in the top face from the rear edge side to the front edge side;

a crosslink including, a first link member having a first end connected to a first portion of the keytop and a second end connected to a first portion of the switch holding frame, and a second link member having a first end connected to a second portion of the keytop, and a second end connected a second portion of the switch holding frame; and a rotatable fulcrum connecting the first link member and the second link member, the rotatable fulcrum being positioned nearer to the front edge side of the keytop as compared to a midpoint position between the first and second ends of at least one of the first and second link members, enabling the top face of the keyboard to become almost parallel to the switch holding frame when the keytop is pressed down to the lowermost position for activation of the keyboard switch.

2. The keyboard switch according to claim 1, wherein said keytop has a bottom face, said keyboard switch further comprising:

a membrane switch sheet on the switch holding frame;

an electrode at a predetermined position on the membrane switch sheet; and means for deforming in contact with the membrane sheet and a projection from the bottom face of the keytop, said means for deforming keeping said keytop in the uppermost position when the keyboard switch is not activated and deforming when the keytop is pushed down for activation of the keyboard switch to short-circuit the electrode on the membrane switch sheet, said keytop including a concave portion on the bottom face proximate the projection, said concave portion housing said means for deforming when said keyboard switch is in a non-operational position, different from the uppermost position of the keytop.

3. The keyboard switch according to claim 2, wherein said switch holding frame and keytop are displaced a predetermined lateral distance with respect to the membrane switch sheet when said keyboard switch is in the non-operational position, enabling said means for deforming to be housed in said concave portion.

4. The keyboard switch according to claim 3, wherein said predetermined lateral distance is equivalent to a width of said means for deforming taken in a direction in which said switch holding frame and keytop are displaced through said predetermined lateral distance with respect to the membrane switch sheet.

5. A keyboard switch comprising:

a switch holding frame;

a keytop having a top face, a front edge side and a rear edge side, said keytop being positioned at an uppermost position when the keyboard switch is not activated and at a lowermost position when the keytop is pressed vertically down for activation of the keyboard switch, said front edge side of the keytop being positioned lower than the rear edge side when the keytop is in the uppermost position, forming a slant in the top face from the rear edge side to the front edge side;

a crosslink including, a first link member having a first end connected to a first portion of the keytop and a second end connected to a first portion of the switch holding frame, and a second link member having a first end connected to a second portion of the keytop, and a second end connected a second portion of the switch holding frame; and a rotatable fulcrum connecting the first link member and the second link member, the first portion of the keytop being proximate the rear edge side and the second portion of the keytop being proximate the front edge side, and at least one of, i) the length between the rotatable fulcrum and the first end of the first link member being greater than both the length between the rotatable fulcrum and the second end of the first link member and the length between the rotatable fulcrum and the first end of the second link member, and ii) the length between the rotatable fulcrum and the second end of the second link member being greater than both the length between the rotatable fulcrum and the first end of the second link member and the length between the rotatable fulcrum and the second end of the first link member.

6. The keyboard switch according to claim 5, wherein said keytop has a bottom face, said keyboard switch further comprising:

a membrane switch sheet on the switch holding frame;

an electrode at a predetermined position on the membrane switch sheet; and means for deforming in contact with the membrane sheet and a projection from the bottom face of the keytop, said means for deforming keeping said keytop in the uppermost position when the keyboard switch is not activated and deforming when the keytop is pushed down for activation of the keyboard switch to short-circuit the electrode on the membrane switch sheet, said keytop including a concave portion on the bottom face proximate the projection, said concave portion housing said means for deforming when said keyboard switch is in a non-operational position, different from the uppermost position of the keytop.

7. The keyboard switch according to claim 6, wherein said switch holding frame and keytop are displaced a predetermined lateral distance with respect to the membrane switch sheet when said keyboard switch is in the non-operational position, enabling said means for deforming to be housed in said concave portion.

8. The keyboard switch according to claim 7, wherein said predetermined lateral distance is equivalent to a width of said means for deforming taken in a direction in which said switch holding frame and keytop are displaced through said predetermined lateral distance with respect to the membrane switch sheet.

* * * * *